US006419469B1

(12) United States Patent
Shulver et al.

(10) Patent No.: US 6,419,469 B1
(45) Date of Patent: Jul. 16, 2002

(54) PUMP HAVING A MAIN OUTLET COMMUNICATING WITH A SECONDARY OUTLET BY A GAP

(75) Inventors: David Robert Shulver; Michael David Rowe; Nigel John Goodall, all of Kent (GB)

(73) Assignee: Dana Automotive Limited, Kent (GB)

( * ) Notice: Subject to any disclaimer, the term of this patent is extended or adjusted under 35 U.S.C. 154(b) by 0 days.

(21) Appl. No.: 09/666,480

(22) Filed: Sep. 20, 2000

(30) Foreign Application Priority Data

Sep. 22, 1999 (GB) ..... 9922360

(51) Int. Cl.[7] ..... F04C 2/10
(52) U.S. Cl. ..... 418/15; 418/171
(58) Field of Search ..... 418/15, 170, 171

(56) References Cited

U.S. PATENT DOCUMENTS

| | | | | | |
|---|---|---|---|---|---|
| 2,228,933 | A | * | 1/1941 | Thomson | 418/15 |
| 2,513,984 | A | * | 7/1950 | Witchger | 418/171 |
| 2,732,802 | A | * | 1/1956 | Eames, Jr. | 418/15 |
| 3,045,778 | A | * | 7/1962 | Mosbacher | 418/15 |
| 4,021,155 | A | | 5/1977 | Erickson et al. | 417/302 |
| 4,659,296 | A | * | 4/1987 | Bristow | 418/15 |

FOREIGN PATENT DOCUMENTS

| | | |
|---|---|---|
| DE | 198 04 207 | 8/1998 |
| GB | 681 883 | 10/1952 |
| JP | 08 159048 | 6/1996 |
| JP | 08 247047 | 9/1996 |

OTHER PUBLICATIONS

Patent Abstracts Of Japan vol. 018, No. 498 (M–1675), Sep. 19, 1994 (Sep. 19, 1994) & JP 06 167278 A (Toyota Motor Corp), Jun. 14, 1994 (Jun. 14, 1994) *abstract*.

Patent Abstracts Of Japan vol. 008, No. 154 (M–310), Jul 18, 1984 (Jul. 18, 1984) & JP 59 049383 A (Matsushita Denki Sangyo KK), Mar. 21, 1984 (Mar. 21, 1984) *abstract*.

Patent Abstracts Of Japan vol. 008, No. 154 (M–310), Jul. 18, 1984 (Jul. 18, 1984) & JP 59–049384 A (Matsushita Denki Sangyo KK), Mar. 21, 1984 (Mar. 21, 1984) *abstract*.

* cited by examiner

*Primary Examiner*—John J. Vrablik
(74) *Attorney, Agent, or Firm*—Wenderoth, Lind & Ponack, L.L.P.

(57) ABSTRACT

A pump has meshing inner and outer rotors mounted eccentrically in a housing. The pump also has an inlet and a main outlet. The main outlet communicates via a control gap with a secondary outlet. The control gap provides a filtering action for some of the fluid pumped.

18 Claims, 6 Drawing Sheets

PUMP HAVING A MAIN OUTLET COMMUNICATING WITH A SECONDARY OUTLET BY A GAP

GROUND OF THE INVENTION

The invention relates to pumps and more particularly, but not exclusively, to pumps of the type comprising an externally toothed or lobed inner rotor mounted eccentrically within and meshing with an internally toothed or lobed rotor. One pump of this type comprises a lobed inner rotor which rotates eccentrically within an outer rotor having one more lobe than the inner rotor, the inner and outer rotors making permanent sliding contact at points spaced around their periphery and defining sealed spaces which decrease in volume between fixed inlet and outlet ports.

Pumps of this type are often used as oil pumps in internal combustion engines. The pump rotors are generally mounted in a housing, part of which may be constituted by a pocket in the engine block, and a driving shaft projects into the housing to drive the inner rotor which in turn drives the outer rotor.

BRIEF SUMMARY OF THE INVENTION

According to the present invention there is provided a pump comprising a housing, pumping elements mounted within the housing for pumping fluid from an inlet to a main outlet. The main outlet communicates with a secondary outlet by way of a control gap which filters the fluid passing into the secondary outlet.

In preferred arrangements, the housing comprises a body portion and a cover plate. The body portion is formed so as to define the inlet and outlets and provides a wall to define with the outer rotor, the control gap between the main and secondary outlets.

It is a preferred feature that the secondary outlet has an orifice through which filtered fluid can flow. Ideally the orifice is connected to external tubing to direct the filtered fluid to predetermined locations.

In certain embodiments, the pumping elements comprise an externally toothed or lobed inner rotor mounted eccentrically within and meshing with an internally toothed or lobed outer rotor which is mounted for rotation within and relative to the housing. Conveniently, the inner rotor is adapted to be driven in rotation, the rotation causing rotation of the outer rotor.

BRIEF DESCRIPTION OF THE DRAWINGS

Embodiments of the present invention will now be described in more detail with reference to the accompanying drawings in which.

DETAILED DESCRIPTION OF THE INVENTION

Figure 1:
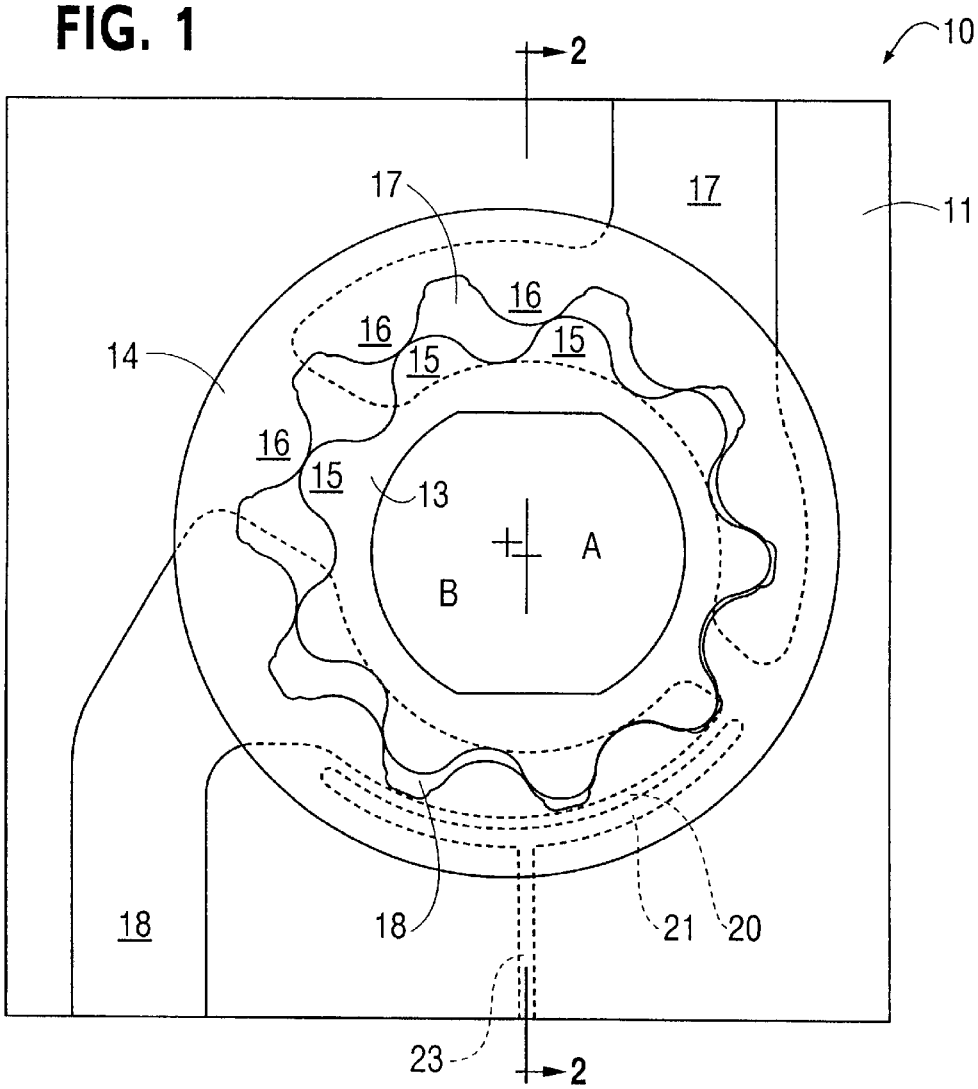
FIG. 1 is a plan view of an interior of a housing body of a pump, according to the present invention, with rotors inserted.
Figure 2:
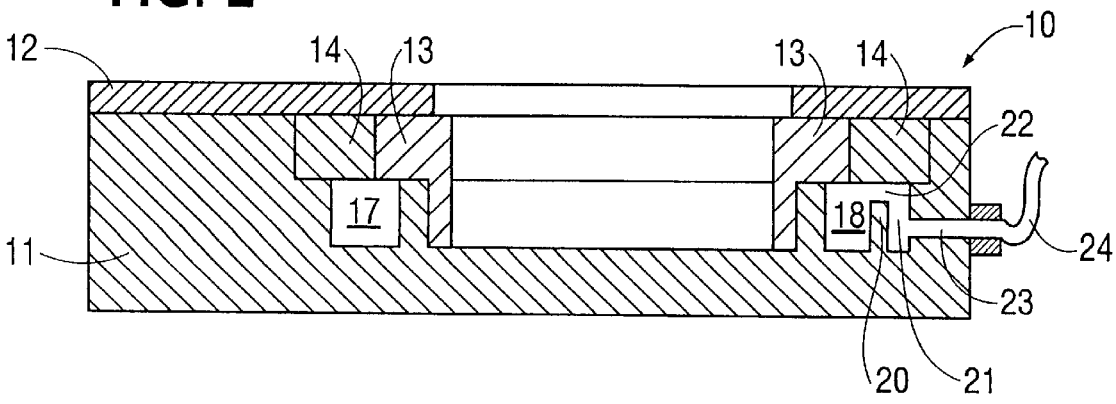
FIG. 2 is a section on line II—II of the housing body of FIG. 1 with rotors inserted and a cover plate attached.

In FIGS. 1 and 2 there is shown a pump 10 comprising a housing having a main body 11 and a cover plate 12. The main body 11 is formed so as to provide a pocket for receiving an inner rotor 13 and an outer rotor 14. The housing also provides a fluid inlet 17 and a main outlet 18. The inner rotor 13 is, in use, driven about its central axis A by a drive shaft (not shown) which projects through the cover plate 12. The inner rotor 13 has external lobes 15 and the outer rotor 14 has internal lobes 16, there being one more lobe 16 than lobes 15. The rotation of the inner rotor 13 causes the outer rotor 14 to rotate about its central axis B, the rotors being eccentrically mounted relative to each other. The lobes 15, 16 make sliding contact and a pumping action is effected by the decreasing volume of the sealed spaces between the inner and outer rotors from the inlet 17 to the main outlet 18. The general operating principal of this type of pump is known.

In pump 10, the main body 11 of the housing provides a wall 20 which defines one edge of the main outlet 18. Radially outwards of the wall 20 is a secondary outlet 21. Fluid pumped from the inlet 17 to the main outlet 18 is able to pass into the secondary outlet through a control gap 22 between the end of the wall 20 and the outer rotor 14. The control gap 22 is of a predetermined size (this is exaggerated in the drawings for the sake of clarity) so as to provide a filtering action for fluid passing into the secondary outlet. Clearly the size of the gap 22 is chosen so as to provide a desired filtering action.

The secondary outlet 21 has an orifice 23 to which a tube 24 or tubes are connected to direct the filtered fluid to a chosen location. In alternative arrangements the filtered fluid may be directed to oil galleries which may be internal or external to the pump or may be sprayed directly from the orifice 23 to a required location.

The pump 10 is suited to use in an internal combustion engine to pump lubricating oil from the inlet 17 to the main outlet 18. Oil from the main outlet 18 can be used for some lubrication purposes, but filtered oil entering the secondary outlet 21 can be used for specific lubrication purposes where it is important not to have large foreign bodies in the oil.

In one particular example, favorable results have been obtained with a control gap 22 of 175 $\mu$m±50 $\mu$m. However, it should be stressed that this is merely an example of one suitable arrangement and other sized gaps can be used depending on the filtering effect required. Also, the radial length of the secondary outlet can be varied.

Figure 3:
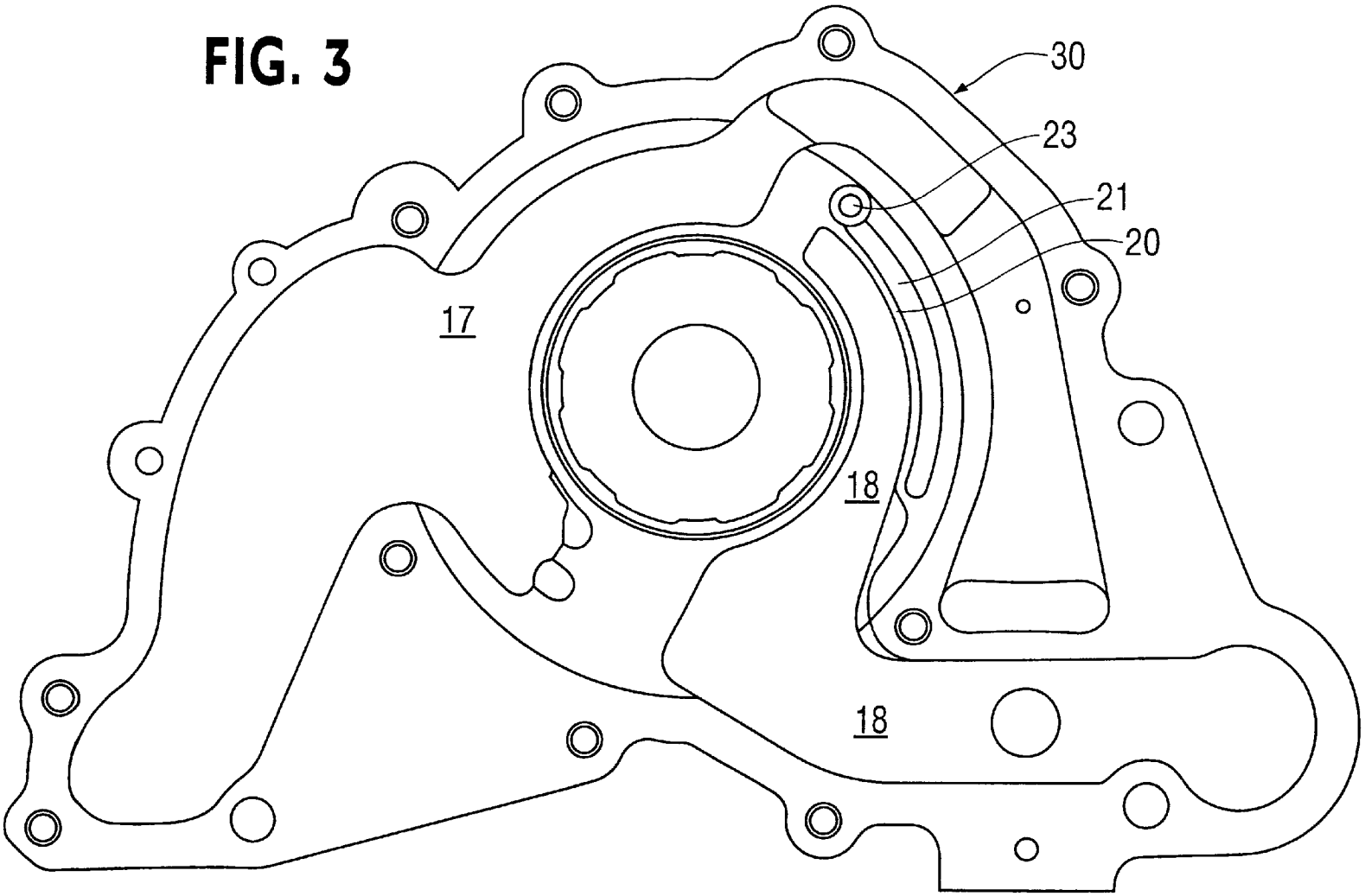
FIG. 3 is a side view of an interior of a housing body of an alternative pump according to the present invention.

FIG. 3 shows a more complicated housing main body 30 for a pump 10. Many features are the same as for the embodiment shown in FIGS. 1 and 2 and so have been given the same reference numerals. There are some differences to the precise form of the inlet 17 and main outlet 18. In addition the orifice 23 leading from the secondary outlet 21 extends generally axially relative to the rotors 13, 14, rather than generally radially, as in the first embodiment.

Figure 4:
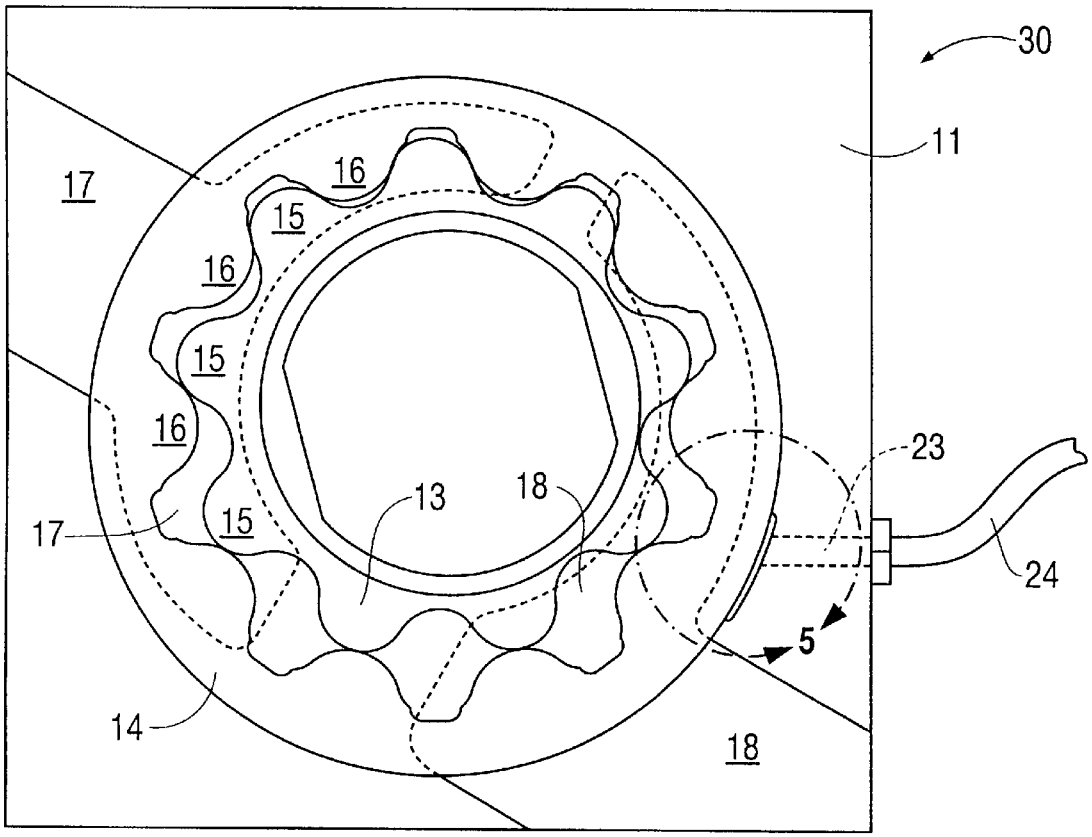
FIG. 4 is a plan view of an interior of a housing body of an alternative pump according to the present invention.
Figure 5:
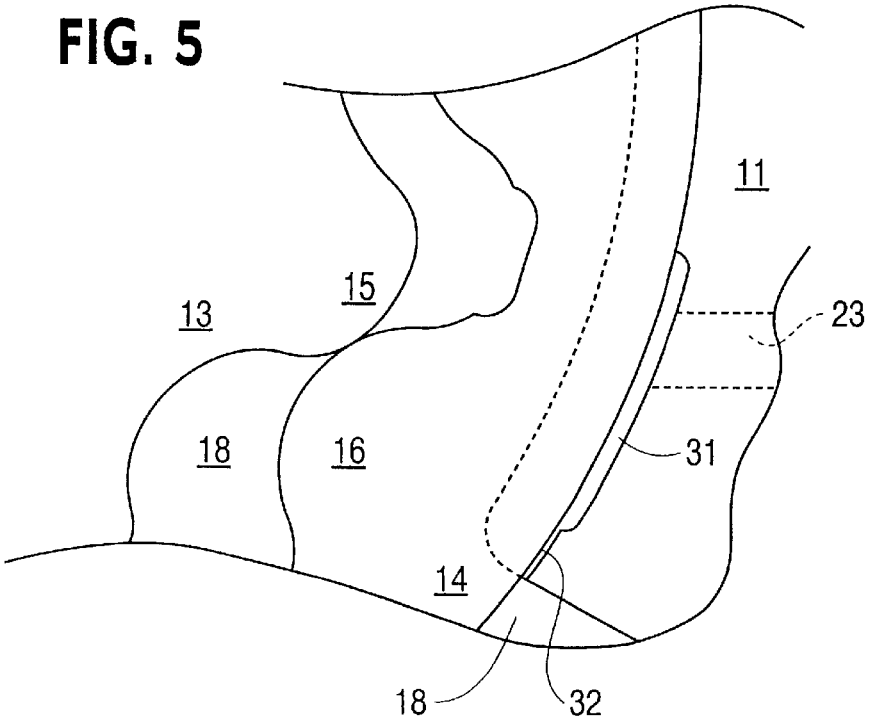
FIG. 5 is an enlarged view of part of FIG. 4.

In FIGS. 4 and 5 there is shown an alternative pump 30 in which many features are similar to the pump 10 in FIGS.

1 and 2. Like parts have, therefore, been given like reference numerals. In FIGS. 4 and 5, however, the wall 20 has been omitted and the secondary outlet 31 is formed as a recess in the wall of the housing main body 11 radially outwards of the outside diameter of the outer rotor 14. The recess 31 communicates with the outlet 18 by a control gap 32 formed in the housing main body 11. The control gap 32 is again of a predetermined radial width to provide a filtering action and can be the normal clearance between the outer rotor 14 and the main body 11 of the housing.

Figure 6:
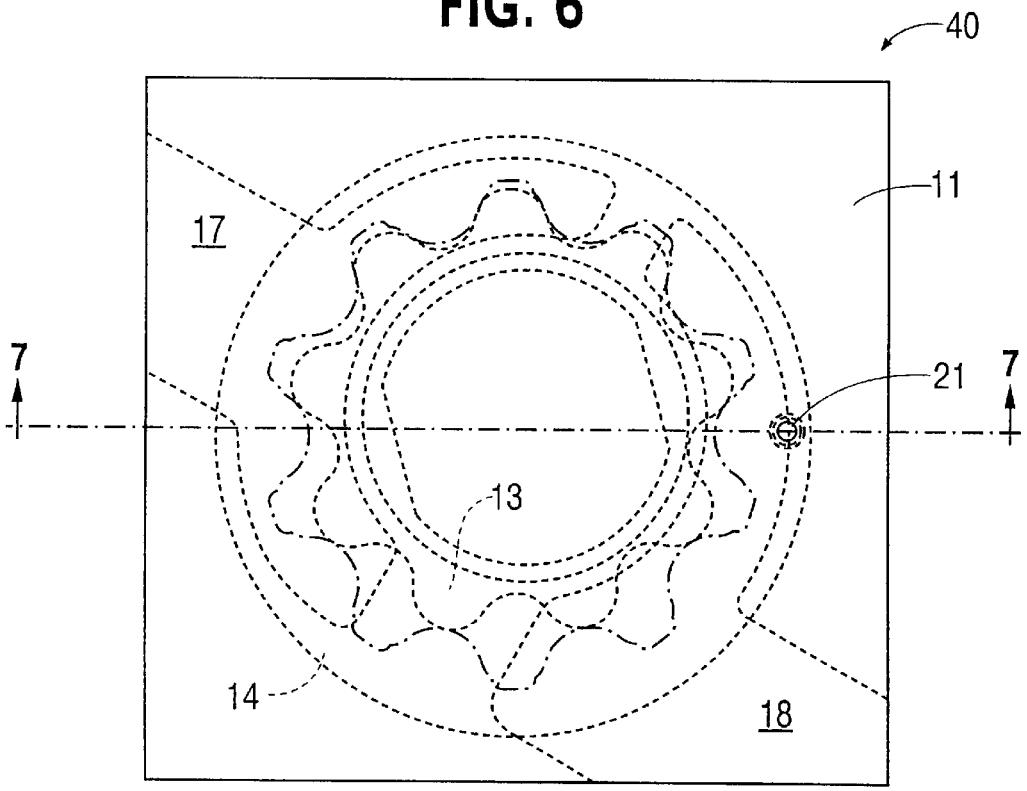
FIG. 6 is a plan view of another alternative pump according to the present invention.
Figure 7:
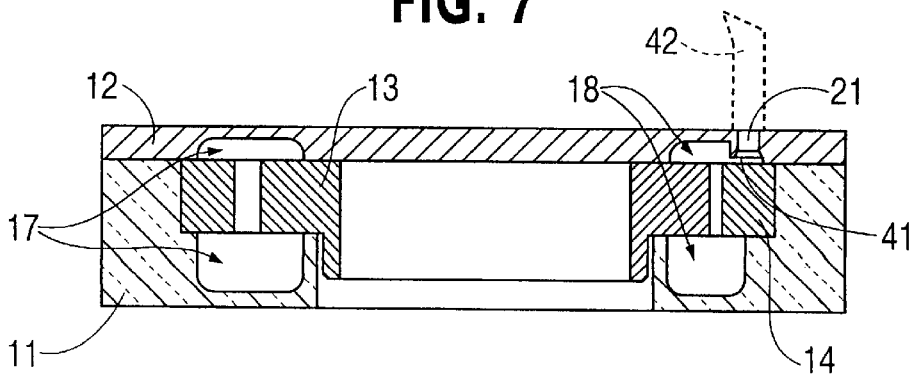
FIG. 7 is a cross-section on line VII—VII of FIG. 6.

In FIGS. 6 and 7 there is shown another embodiment of a pump 40. Again, features in common with pump 10 shown in FIGS. 1 and 2 have been given the same reference numbers. In FIGS. 6 and 7, the inlet 17 and the outlet 18 are provided in the main body 11 of the housing and also in the cover plate 12. The outlet 18 in the cover plate 12 extends partially over the top axial face of the outer rotor 14 and communicates by way of a control gap 41 with the secondary outlet 21. This secondary outlet 21 in the cover plate 12 may be suitable for spraying filtered fluid directly onto a chain or gear, for example, or may have an optional spray jet component 42 coupled to it, as shown in broken lines in FIG. 7.

In FIGS. 8 and 9, again parts similar to those in FIGS. 1 and 2 have been given the same reference numbers. A pump 50 in FIGS. 8 and 9 has a secondary outlet 51 in the form of a tube 52 which extends through the main body 11 of the housing and through the outlet so as to communicate at its radially inner end with a bearing surface 53 for an axially extending spigot portion 54 of the inner rotor 13. Fluid passes from the lower outlet 18 through the bearing clearance and into the radially inner end of the tube 52.

It will be appreciated that the control gap described above may sometimes be the actual clearances between two existing components, but sometimes these clearances may need to be enlarged to ensure that there is sufficient flow.

In the configurations shown, a number of the configurations show oil being drawn directly through a clearance, whilst others require a step to be introduced to achieve the desired clearance locally, where the available clearance is insufficient to establish a reasonable flow. The requirement for a local step depends on the clearance between components in a particular pump design. In the majority of pump designs, it should be possible to draw a flow of oil through the rotor bearing clearances. A local step would normally, but not always, be required when drawing oil through axial clearances (as these are generally smaller). However, some pump designs, perhaps in high pressure applications, may require a local step to draw oil from radial clearances.

Figure 8:
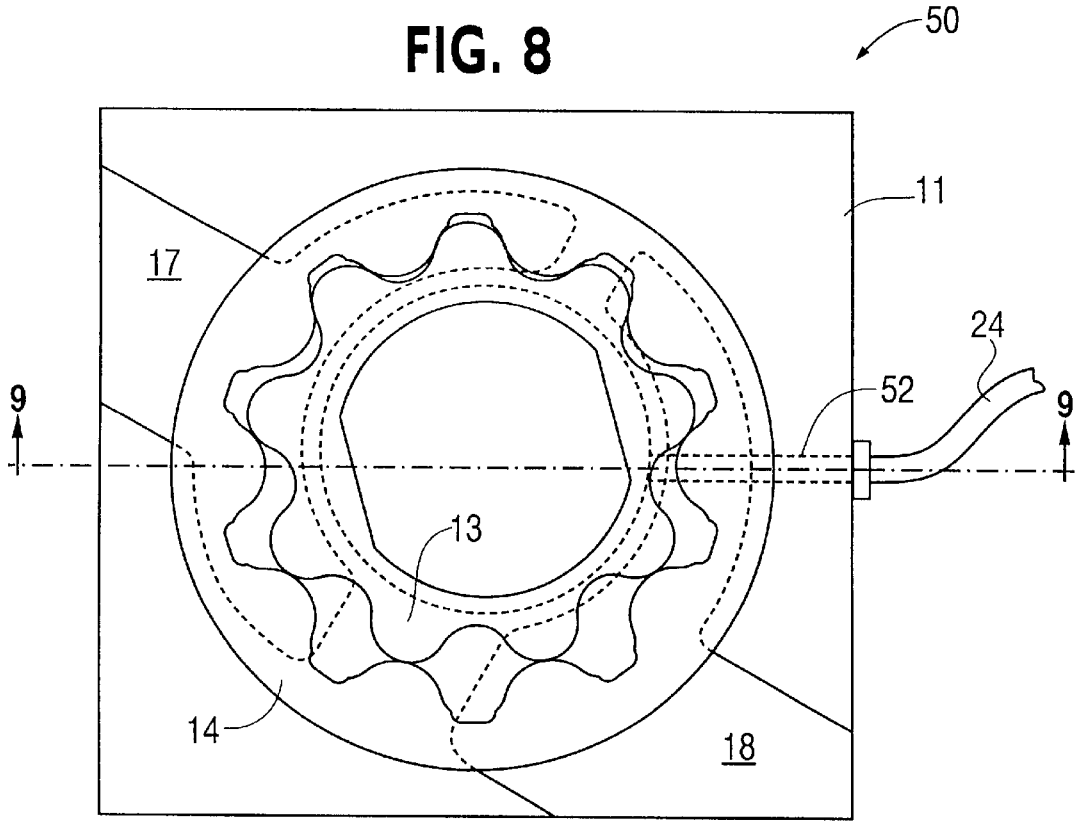
FIG. 8 is a plan view of an interior of a housing body of a further alternative pump according to the present invention.
Figure 9:
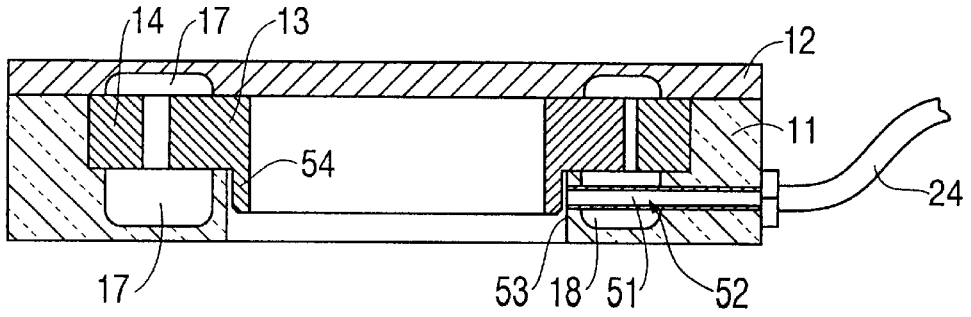
FIG. 9 is a cross-section on line IX—IX of FIG. 8 with a cover plate attached.
Figure 10:
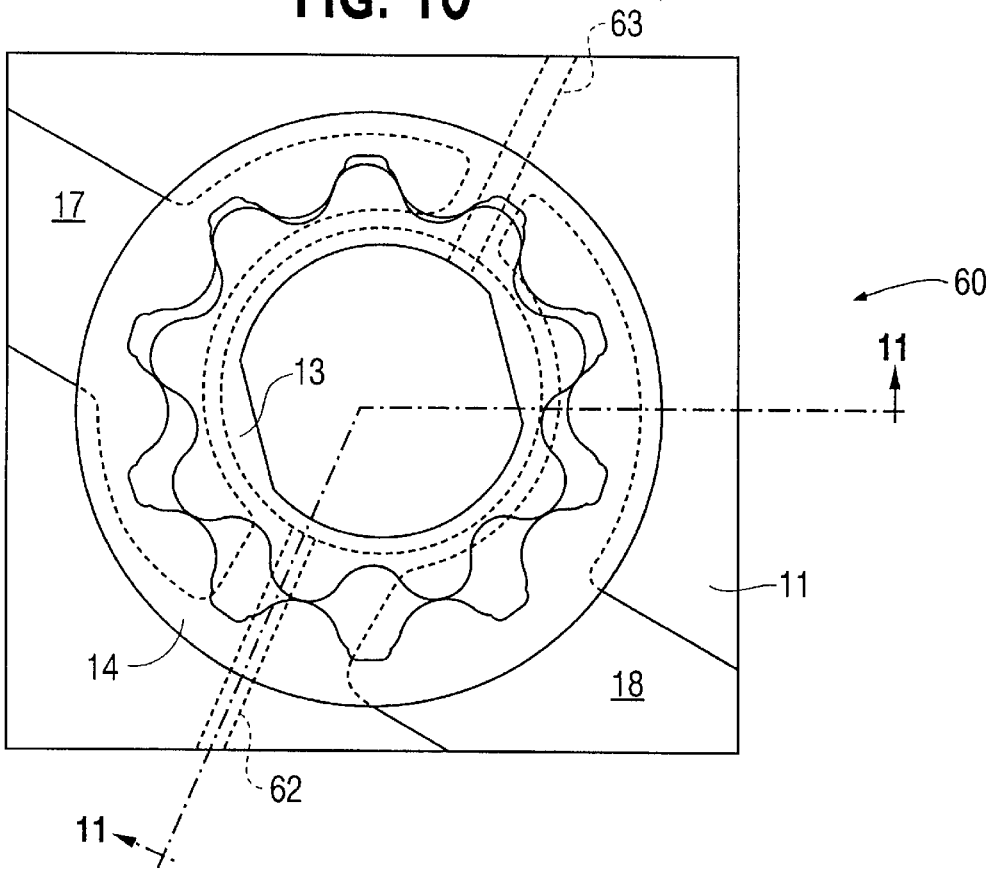
FIG. 10 is a plan view of an interior of a housing body of a still further pump according to the present invention.
Figure 11:
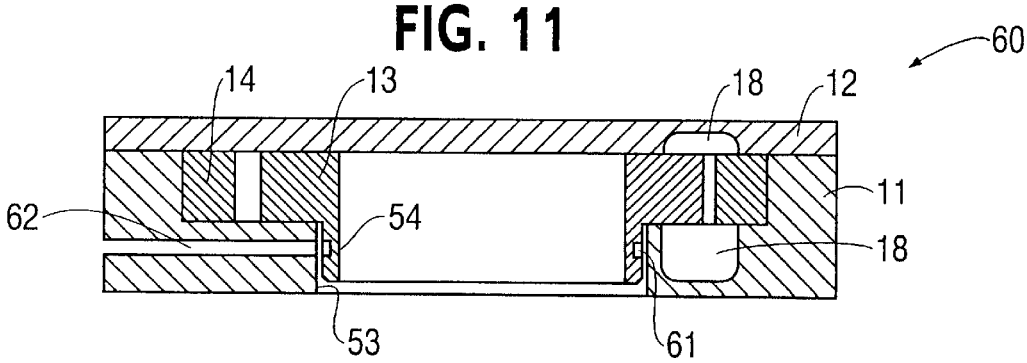
FIG. 11 is a cross-section on line XI—XI of FIG. 10 with a cover plate attached.

In FIGS. 10 and 11, there is shown a further embodiment of pump 60 and again parts similar to those in FIGS. 8 and 9 have been given the same reference numerals. A circumferential groove 61 is formed in the radially outer bearing surface of the spigot portion 54 of the inner rotor 13. A secondary outlet in the form of a bore 62 through the main body 11 of the housing is provided, the bore 62 opening at its inner end in the bearing surface 53 opposite the groove 61. An alternative bore position 63 is also shown in FIG. 10.

In this arrangement, fluid passing through the inner rotor bearing clearance is drawn into the groove 61. The fluid is then free to pass around the inner rotor to be drawn off along the bore 62 which constitutes the secondary outlet.

Two bore examples are shown, but others are possible. This variation could be achieved in certain configurations on the inner or outer rotor, on either axial or radial faces. A filter step may be required to achieve the required flow rate of fluid and filtering effect, although in some cases this step feature may not be required (as shown in FIGS. 10 and 11) where the available clearances are suitable for both purposes.

Although the control gap for filtering outlet fluid has been described above in connection with n (n+1) type pumps, it will be appreciated that the same principle could be used in the outlet regions of other types of pumps, such as vane or roller type pumps, and internal and external gear pumps.

We claim:

1. A pump comprising:

a housing having an inlet, a main outlet, a secondary outlet, and a control gap; and pumping elements mounted within said housing, said pumping elements being operable to pump fluid from the inlet to the main outlet, wherein the secondary outlet only receives the fluid from the main outlet by way of the control gap which filters the fluid passing into the secondary outlet, and the secondary outlet passes the fluid for external use outside the pump.

2. A pump as claimed in claim 1, wherein said housing comprises:

a body portion formed so as to define the inlet, the main outlet, the secondary outlet, and a wall; and a cover plate, wherein said wall and one of said pumping elements define the control gap between the main outlet and the secondary outlet.

3. A pump as claimed in claim 2, wherein the secondary outlet has an orifice through which filtered fluid can flow.

4. A pump as claimed in claim 2, wherein said pumping elements comprise:

an internally toothed or lobed outer rotor rotatably mounted within and relative to said housing; and an externally toothed or lobed inner rotor mounted eccentrically within and meshing with said internally toothed or lobed outer rotor.

5. A pump as claimed in claim 1, wherein the control gap is provided by a clearance between one of said pumping elements and said housing.

6. A pump as claimed in claim 5, wherein the secondary outlet has an orifice through which filtered fluid can flow.

7. A pump as claimed in claim 5, wherein said pumping elements comprise:

an internally toothed or lobed outer rotor rotatably mounted within and relative to said housing; and an externally toothed or lobed inner rotor mounted eccentrically within and meshing with said internally toothed or lobed outer rotor.

8. A pump as claimed in claim 5, wherein the clearance is an axial clearance.

9. A pump as claimed in claim 8, wherein the secondary outlet has an orifice through which filtered fluid can flow.

10. A pump as claimed in claim 8, wherein said pumping elements comprise:

an internally toothed or lobed outer rotor rotatably mounted within and relative to said housing; and an externally toothed or lobed inner rotor mounted eccentrically within and meshing with said internally toothed or lobed outer rotor.

11. A pump as claimed in claim 5, wherein the clearance is a radial clearance.

12. A pump as claimed in claim 11, wherein the secondary outlet has an orifice through which filtered fluid can flow.

13. A pump as claimed in claim 11, wherein said pumping elements comprise:

an internally toothed or lobed outer rotor rotatably mounted within and relative to said housing; and an externally toothed or lobed inner rotor mounted eccentrically within and meshing with said internally toothed or lobed outer rotor.

14. A pump as claimed in claim 1, wherein the secondary outlet has an orifice through which filtered fluid can flow.

15. A pump as claimed in claim 14, further comprising external tubing connected to the orifice, wherein said external tubing directs the filtered fluid to predetermined locations.

16. A pump as claimed in claim 14, wherein said pumping elements comprise:

an internally toothed or lobed outer rotor rotatably mounted within and relative to said housing; and an externally toothed or lobed inner rotor mounted eccentrically within and meshing with said internally toothed or lobed outer rotor.

17. A pump as claimed in claim 1, wherein said pumping elements comprise:

an internally toothed or lobed outer rotor rotatably mounted within and relative to said housing; and an externally toothed or lobed inner rotor mounted eccentrically within and meshing with said internally toothed or lobed outer rotor.

18. A pump as claimed in claim 17, wherein said externally toothed or lobed inner rotor is operable to be driven in rotation, the rotation causing said internally toothed or lobed outer rotor to rotate.

* * * * *